United States Patent [19]

Prescott

[11] Patent Number: 4,591,290

[45] Date of Patent: May 27, 1986

[54] COMBINATION ADJUSTABLE VALVE BOX ADAPTER AND REPLACEMENT FOR BROKEN VALVE BOXES

[75] Inventor: Everett J. Prescott, Gardiner, Me.

[73] Assignee: Everett J. Prescott, Inc., Gardiner, Me.

[21] Appl. No.: 527,430

[22] Filed: Aug. 29, 1983

Related U.S. Application Data

[63] Continuation-in-part of Ser. No. 360,798, Mar. 22, 1982, abandoned, which is a continuation-in-part of Ser. No. 180,394, Aug. 22, 1980, abandoned.

[51] Int. Cl.[4] ..... E02D 29/14

[52] U.S. Cl. ..... 404/25; 404/26; 52/20

[58] Field of Search ..... 404/25, 26; 137/364, 137/370, 371; 52/20, 21

[56] References Cited

U.S. PATENT DOCUMENTS

| | | | |
|---|---|---|---|
| 599,457 | 2/1898 | Sanborn | 404/26 |
| 1,639,495 | 8/1927 | Frame | 52/20 X |
| 2,593,918 | 4/1952 | Redman | 404/26 |
| 2,930,295 | 3/1960 | Hale | 404/26 |
| 3,215,052 | 11/1965 | Lindstad et al. | 404/26 |
| 3,331,295 | 7/1967 | Sorrell | 404/26 |
| 3,408,778 | 11/1968 | Mason | 52/20 |
| 3,858,998 | 1/1975 | Larsson et al. | 404/26 |
| 4,149,816 | 4/1979 | Piso | 404/26 |
| 4,187,647 | 2/1980 | Hall | 52/20 |

*Primary Examiner*—Stephen J. Novosad
*Assistant Examiner*—Matthew Smith
*Attorney, Agent, or Firm*—William Nitkin

[57] ABSTRACT

A valve box adapter comprising an adapter frame for insertion into a valve box which adapter frame includes an elongated narrow tapered skirt contiguous with a horizontally extending portion at its top adapted in one embodiment for the exterior bottom of said extending portion to rest upon the seat of the valve box and further having an upwardly extending portion contiguous with the horizontally extending portion forming an adapter rim having angled sides and a downwardly beveled top, said adapter adapted to fit within an existing valve box and to receive a smaller cover than was in the original valve box such cover resting upon the inner upper portion of the horizontally extending member forming a seat for the new cover.

5 Claims, 3 Drawing Figures

COMBINATION ADJUSTABLE VALVE BOX ADAPTER AND REPLACEMENT FOR BROKEN VALVE BOXES

This application is a continuation-in-part of my previously filed application for Adjustable Valve Box Adapter and Replacement for Broken Valve Boxes, Ser. No. 360,798 filed Mar. 22, 1982 now abandoned which was a continuation-in-part application of my previously filed application for An Adjustable Manhole Frame, Ser. No. 180,394 filed Aug. 22, 1980, now abandoned.

BACKGROUND OF THE INVENTION

1. Field of the Invention

The field of this invention resides in the area of adjustable valve box adapters to raise or lower a valve box cover when needed.

2. History of the Prior Art

When the level of a street changes, for example by the addition of more pavement or by the settling of the roadbed, it is usually necessary to completely dig up the entire valve box frame to reinstall them at the new grade level. This procedure is costly and causes traffic delays. Also if a valve box is broken such as by its rim having been struck by a snow plow or the like, one would have to dig it out of the ground and replace it. In order to avoid the digging out of such valve boxes, several different types of adapters have been utilized to raise or lower the valve box cover to the new grade of the roadway. One such type is called a fixed adapter which is available in various heights such as 1" or 2", etc. and which rests on the top rim of the existing in-street valve box. Many times though the top rim can be worn, damaged or uneven which condition may eventually cause such adapters to shift and become dislodged. Another type of adapter is the slip or slide adapter which has skirts of various lengths that slide into the valve box barrel section to adjust to various heights. Such adapters are limited to a minimum raising height of 2" or 3" because its cover support section being the diameter of the valve box rim extends above it and is thicker than the standard thickness of the pavement. Adjustable frames have also been made which include screw adjustment means to lower an inner frame within an outer frame, but these units usually have complex structures which may become impacted with material and fail after a period of time under heavy use. These adapters are also susceptible to frost forming in the threads which often have as much as 1" of play and which ice formation can cause damage to the adapters due to expansion therein.

SUMMARY OF THE INVENTION

It is an object of this invention to provide an improved multi-use adapter that can be used instead of replacing broken valve box top sections and which adapter can also act as a riser of variable heights and slopes for new pavement levels. The adapter of this invention can be easily raised more than once without the necessity of digging it out, disturbing the pavement or otherwise removing the valve box of the original installation. A further use of this invention can be to use it with its cover to replace a lost, nonstandard sized cover if a similar one cannot be located.

The adapter of this invention is simple in design and use and is economical to produce. This invention utilizes a specially formed adapter frame member which can be inserted into the existing valve box in some embodiments, to rest on the cover seat of the original valve box and which adapter further fits within the top rim of the original valve box and has its own cover seat for receiving a new smaller valve box cover therein to replace the old original larger valve box cover. Between the adapter of this invention and the original valve box, in situations where it is desired to raise the cover to a new level or grade, there may be inserted packing material around the seat of the original valve box in which is positioned the adapter of this invention. If necessary packing such as rope or other sealing means can be wrapped around the elongated tapered skirt of this adapter and the packing material can be impacted down to such seal member. The packing material may extend between the adapter and the original valve box up to the level of the roadway but in some embodiments the packing need only extend to the top of the original valve box while the pavement material may cover thereover up to the beveled edge of the adapter. The downwardly beveled top edge of the adapter rim prevents the adapter from being struck by plows and the like so it will not be dislodged. The amount of packing will determine the new height of the adapter. Because of the tapered elongated skirt member which is narrower than the valve box barrel, the adapter of this invention can be tilted within its packing material to the grade and slope of the road before it sets.

In some cases the top of the original valve box may be broken, for example by the pavement becoming worn or settled or the valve box may be struck by vehicles such as snow plows. In such situations rather than digging up and replacing the original valve box which can no longer securely retain its cover, one can insert the adapter of this invention directly into the original valve box to rest on its cover seat or, as discussed above, adjusted by packing material to the new height of the pavement. In some situations where frost may have raised the original valve box above the road level rather than digging it out, one can break off its top rim and install the adapter of this invention which has a thinner horizontally extending section, the inner top of which acts as the new cover seat and the bottom of which extending outwardly can rest on the original cover seat. This procedure effectively lowers the new smaller cover seat to the correct height of the pavement.

The narrow tapered skirt extending downward from the horizontally extending portion of the adapter of this invention has many advantages. It not only allows for tilting within the original valve box barrel but also provides this adapter with the ability of being pried directly out of its packing material when it is desired to remove it for resetting without the need of extensive digging as the tapered sides will easily release from contact with the packing material. The diameter of the adapter, being narrower than the diameter of the original valve box, assists in allowing cement or packing material to be applied therebetween which increases the stability and permanence of the installation.

DESCRIPTION OF THE PREFERRED EMBODIMENT(S)

Figure 1:
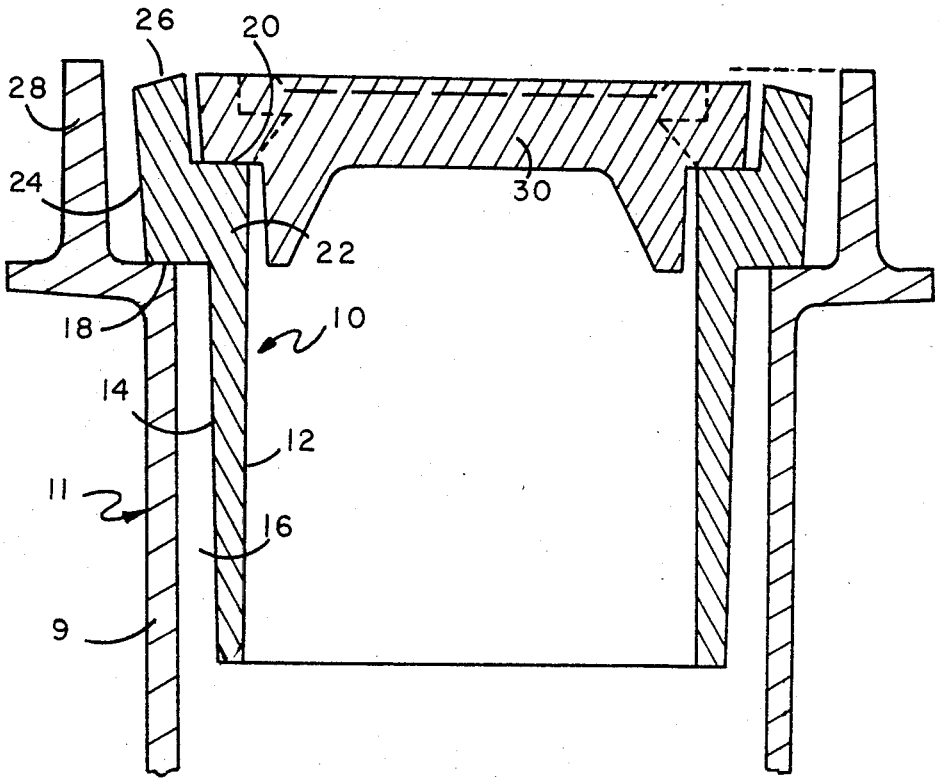
FIG. 1 illustrates a cutaway view of the adapter of this invention in a valve box.

FIG. 1 illustrates a cutaway view of the adapter of this invention. Seen in this view is adapter 10 resting within valve box 11 in the embodiment wherein the adapter rests on valve box seat 18. As can be seen in this view the adapter is generally smaller than valve box 11 with a space 16 provided between the adapter's skirt 12 and valve box barrel 9. The skirt has a downwardly inwardly taper 14 on its exterior portion. The skirt extends upwards to a lateral extension 22, the inner top of which forms seat 20 to receive the new cover 30 which should be of a heavy type with large and stong pickholes. Lateral extension 22 extends outwardly and rises up forming adapter rim 24, the exterior sides of which also are tapered outwardly to its top. The top of adapter rim 24 has a downwardly and outwardly extending bevel 26 to help prevent its upper outer edge from being struck by objects such as snowplows. The taper of the adapter rim and skirt allow the adapter to be lifted up out of its cement packing without needing to dig the cement out.

Figure 2:
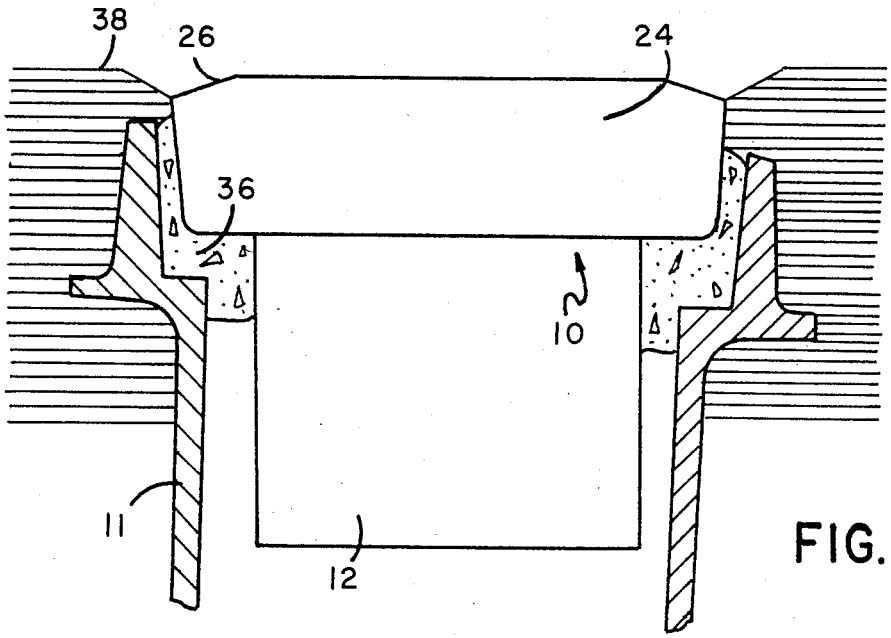
FIG. 2 illustrates a cross-sectional view of the adapter of this invention in a raised and angled position.

In the embodiment shown in FIG. 2 adapter 10 is illustrated in a position where it is used to raise the cover to a new road height and slope 38. The adapter is seen tilted within the valve box so that its top is aligned with the new slope of the road. This tilting is possible due to the adapter's smaller design wherein its skirt is narrower than the barrel of the valve box to allow for the tilting of the adapter. Skirt 12 in a preferred embodiment is approximately 6" in length which allows the adapter to be lifted approximately 4" to 5" above the rim of the original valve box and packed in place with cement 36 while maintaining strength and stability.

Figure 3:
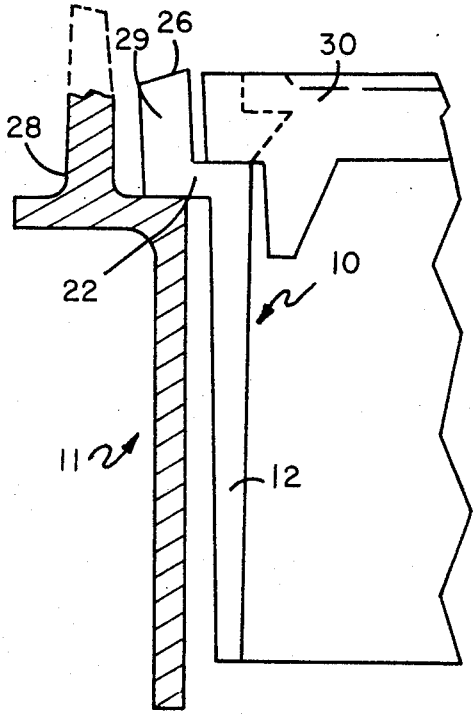
FIG. 3 illustrates the embodiment of the adapter of this invention utilized to lower the cover height within a valve box having its rim broken away.

FIG. 3 illustrates the embodiment of the adapter having a very thin lateral extension 22 allowing the top bevel 26 of the adapter rim to be level with the broken off rim of the original valve box so that the new cover can be installed at a lower height.

Although the present invention has been described with reference to particular embodiments, it will be apparent to those skilled in the art that variations and modifications can be substituted therefor without departing from the principles and spirit of the invention.

I claim:

1. A valve box adaptor adapted to receive an adaptor cover to repair broken valve boxes or to raise or lower the level thereof for use in valve boxes of the type having a seat to receive a valve box cover, such valve boxes being surrounded by a valve box rim with a barrel section extending downwardly within a valve box installation, comprising:

a downwardly extending inwardly tapered elongated skirt of a width more narrow than the width of said valve box barrel;

a horizontally disposed lateral extension having inner and outer portions and having a top and a bottom positioned above said skirt with a bottom inner portion of the lateral extension being contiguous with said skirt, a top inner portion of the lateral extension forming a seat; and, an adaptor rim formed above and contiguous with a top outer portion of the lateral extension, the top of said adaptor rim having a downwardly and outwardly extending bevel, the sides of said adaptor rim being downwardly and inwardly tapered, said adaptor rim further being smaller than the valve box rim, said adaptor receiving an adaptor cover on the seat of said adaptor, said adaptor being supported in one mode of installation upon said valve box seat with said adaptor rim being disposed within said valve box rim and with the adaptor cover being disposed on the adaptor, the lateral extension being of a height when combined with the height of the adaptor rim which is less than the original height of the valve box rim, the level of the adaptor cover relative to a valve box installation being lower than the level of the now removed valve box cover on the valve box installation, the valve box installation thereby being repaired in that situation wherein the valve box rim is broken off or otherwise reduced to a height which is lower than the original height of the valve box rim in the original valve box installation.

2. The valve box adaptor of claim 1 and further comprising packing means disposed between the original valve box and under said lateral extension of the adaptor and around said skirt of said adaptor for raising the level of the valve box installation.

3. The valve box adaptor of claim 2 wherein the adaptor is tiltable within the packing means relative to the valve box to level the adaptor cover.

4. The valve box adaptor of claim 2 wherein the packing means comprises a material which is plastic when applied to the valve box, which molds to the shape of the adaptor while holding the adaptor in spaced relation to the valve box, and which sets to a hardened and solid form to support the adaptor.

5. A method for adjusting the height of a covering of a valve box relative to a roadway or similar surface to accommodate a change in level of the roadway without the necessity for digging up said valve box, said valve box being of a type having a seat for receiving an original cover and being surrounded by a valve box rim with a barrel section extending downwardly, said method comprising the steps of:

determining the width of the original valve box;

providing an adaptor having a tapered downwardly extending skirt contiguous with a lateral extension having a top and bottom, the bottom of which extension is adapted to rest on the seat of the valve box, the inner top portion of said extension being adapted to form an adaptor seat for a cover smaller than the original cover of the valve box, said lateral extension extending to an outer, upwardly-extending adaptor rim having a downwardly beveled top wherein the width of the skirt of the adaptor is more narrow than the width of said barrel of said valve box and the width of said adaptor rim is more narrow than the width of the rim of said valve box;

determining the height and slope of the change in level of the roadway;

positioning said adaptor so that the top of the rim of the adaptor lies at the height and slope of the change in level of the roadway;

adjusting the level of the rim of the valve box to the height of the change in level of the valve box, including the step of breaking away at least portions of the top of the rim to the height of the change of level of the valve box, thereby to lower the height of the valve box;

providing the lateral extension of the adaptor with a vertical thickness which causes the height of the adaptor rim and the relatively smaller cover disposed on the adaptor seat to be at a predetermined height; and, paving said roadway up to the level of the adaptor rim.

* * * * *